US009074606B1

(12) United States Patent
Moore

(10) Patent No.: US 9,074,606 B1
(45) Date of Patent: Jul. 7, 2015

(54) COMPRESSOR SURGE CONTROL

(75) Inventor: Robert Doak Moore, Plaquemine, LA (US)

(73) Assignee: RMOORE CONTROLS L.L.C., Plaquemine, LA (US)

( * ) Notice: Subject to any disclaimer, the term of this patent is extended or adjusted under 35 U.S.C. 154(b) by 625 days.

(21) Appl. No.: 13/410,782

(22) Filed: Mar. 2, 2012

(51) Int. Cl.
*F04D 27/02* (2006.01)

(52) U.S. Cl.
CPC ..... *F04D 27/0207* (2013.01)

(58) Field of Classification Search
CPC ..... F04D 27/02; F04D 27/001; F04D 27/009; F04D 27/0207
USPC ..... 417/253
See application file for complete search history.

(56) References Cited

U.S. PATENT DOCUMENTS

| | | | | |
|---|---|---|---|---|
| 4,142,838 | A | 3/1979 | Staroselsky | |
| 4,594,051 | A | 6/1986 | Gaston | |
| 4,825,380 | A * | 4/1989 | Hobbs | 700/266 |
| 4,861,233 | A | 8/1989 | Dziubakowski et al. | |
| 4,949,276 | A | 8/1990 | Staroselsky et al. | |
| 4,971,516 | A | 11/1990 | Lawless et al. | |
| 5,195,875 | A | 3/1993 | Gaston | |
| 5,599,161 | A | 2/1997 | Batson | |
| 5,908,462 | A | 6/1999 | Batson | |
| 6,164,901 | A * | 12/2000 | Blotenberg | 415/1 |
| 6,494,672 | B1 | 12/2002 | Khots et al. | |
| 6,503,048 | B1 * | 1/2003 | Mirsky | 415/1 |
| 7,025,558 | B2 | 4/2006 | Blotenberg | |
| 7,094,019 | B1 | 8/2006 | Shapiro | |
| 7,210,895 | B2 | 5/2007 | Kotani et al. | |
| 2008/0264067 | A1 | 10/2008 | Flucker | |

OTHER PUBLICATIONS

Abraham Frenk and E. Shalman, A slip factor calculation in centrifugal impellers based on linear cascade data, presentation, 2005.
Brun, Klaus et al., Application Guideline for Centrifugal Compressor Surge Control Systems, Gas Machinery Research Council Southwest Research Institute, Apr. 2008.
Mirsky, Saul, Development and design of antisurge and performance control systems for centrifugal compressors, Proceedings of the Forty-Second Turbomachinery Symposium, Oct. 1-3, 2012, Houston, Texas.
Hansen, Claus, Dynamic Simulation of Compressor Control Systems, Thesis, 2008, Esbjerg, Denmark.
(Continued)

*Primary Examiner* — Charles Freay
*Assistant Examiner* — Philip Stimpert
(74) *Attorney, Agent, or Firm* — John B. Edel; Edel Patents LLC

(57) ABSTRACT

Compressors having at least two compressor stages, a compressor discharge a first recycle flow path wherein the first recycle flow path connects the first compressor stage inlet feed and the compressor discharge, a second recycle flow path wherein the second recycle flow path connects the second compressor stage inlet feed and the compressor discharge, measurement devices sufficient to quantify a volumetric flow rate of the first compressor stage inlet feed, and a controller arranged and configured to accept a set of inputs, wherein the set of inputs comprises information sufficient to determine the work imparted by the first compressor stage, wherein the set of inputs is sufficient to quantify a volumetric flow rate of the second compressor stage inlet feed are described herein. Compressors having differing numbers of stages and the control of those compressors are also described.

3 Claims, 3 Drawing Sheets

(56) References Cited

OTHER PUBLICATIONS

Helvoirt, Jan Van et al., Practical issues in model-based surge control for centrifugal compressors, IMechE, 2006, Eindhoven, The Netherlands.

Tri-Sen Turomachinery Controls, Refrigeration Systems.

Oldrich, Jiri, Variable composition gas centrifugal compressor anti-surge protection, Papiernička, Czech Republic, 2004, p. 177-184.

* cited by examiner

COMPRESSOR SURGE CONTROL

Embodiments disclosed herein may be used for the purpose of efficiently and safely controlling the operation of centrifugal compressors. Embodiments disclosed herein are applicable to compressor controls where the molecular weight of the compressed gas is known or knowable and are not dependent on any knowledge or information concerning the discharge conditions of the compressor.

Compressors described herein may, for example comprise a compressor having at least two compressor stages and a compressor discharge; wherein the at least two compressor stages comprise a first compressor stage and a second compressor stage; wherein the first compressor stage has a first compressor stage inlet feed; wherein the second compressor stage has a second compressor stage inlet feed; a first recycle flow path wherein the first recycle flow path connects the first compressor stage inlet feed and the compressor discharge; a second recycle flow path wherein the second recycle flow path connects the second compressor stage inlet feed and the compressor discharge; one or more measurement devices sufficient to quantify a volumetric flow rate of the first compressor stage inlet feed; a controller arranged and configured to accept a set of inputs wherein the set of inputs comprises information sufficient to determine the work imparted by the first compressor stage and wherein the set of inputs is sufficient to quantify a volumetric flow rate of the second compressor stage inlet feed; a first control valve in the first recycle flow path arranged and configured to respond to the volumetric flow rate of the first compressor stage inlet feed and to maintain the volumetric flow rate of the first compressor stage inlet feed above a first minimum volumetric flow rate; and a second control valve in the second recycle flow path arranged and configured to respond to the volumetric flow rate of the second compressor stage inlet feed and to maintain the volumetric flow rate of the second compressor stage inlet feed above a second minimum volumetric flow rate. In a related example, the compressor system may further comprise a molecular weight measuring device arranged and configured to provide information to the controller. In a related example, the compressor system may further comprise a compressible fluid wherein the compressible fluid has a known molecular weight that is substantially constant. In a related example, the one or more measurement devices sufficient to quantify a volumetric flow rate of the first compressor stage inlet feed may comprise a first pressure measurement device measuring the pressure of the first compressor stage inlet feed and wherein the first pressure measurement device is the only pressure measurement device among the one or more measurement devices. In a related example, the first control valve may be arranged and configured to remain closed when the volumetric flow rate of the first compressor stage inlet feed is above 110% of a volumetric flow rate at which surge begins. In a further related example, the second control valve may be arranged and configured to begin opening at a volumetric flow rate of the first compressor stage inlet feed between 105% of a volumetric flow rate at which surge begins and 125% of the volumetric flow rate at which surge begins. In a further related example, the second control valve may be arranged and configured to respond to changes in each of: a temperature of the first compressor stage inlet feed; a pressure of the first compressor stage inlet feed; a flow rate of the first compressor stage inlet feed; a temperature of the second compressor stage inlet feed; a pressure of the second compressor stage inlet feed; a flow rate of the second compressor stage inlet feed; and a quantity of energy imparted to the first compressor stage inlet feed by the first compressor stage. In a still further related embodiment, the second control valve may be arranged and configured to respond to a set of changes consisting essentially of: a temperature of the first compressor stage inlet feed; a pressure of the first compressor stage inlet feed; a flow rate of the first compressor stage inlet feed; a temperature of the second compressor stage inlet feed; a pressure of the second compressor stage inlet feed; a flow rate of the second compressor stage inlet feed; and a quantity of energy imparted on the first compressor stage inlet feed by the first compressor stage. In a still further related embodiment, the controller may be arranged and configured to calculate the quantity of energy added to the first compressor stage inlet feed by the first compressor stage. In a still further related embodiment, the controller may be arranged and configured to calculate the enthalpy of the second compressor stage inlet feed. In a still further related embodiment, the first minimum volumetric flow rate may be less than 110% of a volumetric flow rate which causes compressor surge in the first compressor stage. In a still further related embodiment, the first minimum volumetric flow rate may be less than 115% of a volumetric flow rate which causes compressor surge in the first compressor stage. In a still further related embodiment, the first minimum volumetric flow rate is less than 125% of a volumetric flow rate which causes compressor surge in the first compressor stage. The first minimum volumetric flow rate may be greater than 105% of a volumetric flow rate which causes compressor surge in the first compressor stage.

A single stage compressor described herein may, for example, comprise a first compressor stage; a compressor feed line connected to the first compressor stage; a compressor discharge line; a valve arranged and configured to supply compressed gas from the compressor discharge line to the compressor feed line; a flow meter in the compressor feed line; a temperature measuring instrument in the compressor feed line; and a pressure measuring instrument in the compressor feed line; wherein the valve is arranged and configured to operate in response to changes in measurements taken by the flow meter; wherein the flow meter is the only flow measurement device impacting operation of the valve; wherein the valve is arranged and configured to operate in response to changes in measurements taken by the temperature measuring instrument; and wherein the valve is arranged and configured to operate in response to changes in measurements taken by the pressure measuring instrument. In a related embodiment, the valve may be arranged and configured to operate in response to changes consisting essentially of: changes in measurements taken by the flow meter; changes in measurements taken by the temperature measuring instrument; and changes in measurements taken by the pressure measuring instrument.

A compressor system described herein may, for example, comprise a compressor having at least two compressor stages and a compressor discharge; wherein the at least two compressor stages comprise a first compressor stage and a second compressor stage; wherein the first compressor stage has a first compressor stage inlet feed connected to a first compressor system feed source; wherein the second compressor stage has a second compressor stage inlet feed connected to a second compressor system feed source; a first supplemental flow path wherein the first supplemental flow path connects the first compressor stage inlet feed to a first supplemental feed source; a second supplemental flow path wherein the second supplemental flow path connects the second compressor stage inlet feed to a second supplemental feed source; a first group of measurement devices comprising one or more measurement devices sufficient to quantify a volumetric flow rate of the first compressor stage inlet feed; a second group of measurement devices comprising one or more measurement devices sufficient to quantify a volumetric flow rate of the second compressor stage inlet feed; a first control valve in the first supplemental flow path arranged and configured to respond to the volumetric flow rate of the first compressor stage inlet feed when the volumetric flow rate of the first compressor stage inlet feed falls below a first volumetric flow rate set point; and a second control valve in the second supplemental flow path arranged and configured to respond to the volumetric flow rate of the second compressor stage inlet feed when the volumetric flow rate of the second compressor stage inlet feed falls below a second volumetric flow rate set point.

A method of controlling surge in a multi-stage compressor described herein may, for example, comprise providing a compressor system feed to a compressor having a first stage and a second stage; discharging a compressor discharge stream from the compressor; combining a first portion of the compressor discharge stream with the compressor system feed to create a first stage compressor feed having a first volumetric flow rate; feeding the first stage compressor feed into the first stage; combining a second portion of the compressor discharge stream with a discharge stream from the first stage to create a second stage compressor feed having a second volumetric flow rate; feeding the second stage compressor feed into the second stage; calculating the first volumetric flow rate; controlling the first portion of the compressor discharge stream such that the first volumetric flow rate is maintained near or above a first set point and such that the first volumetric flow rate is maintained above a first stage surge point; calculating the second volumetric flow rate; and controlling the second portion of the compressor discharge stream such that the second volumetric flow rate is maintained near or above a second set point and such that the second volumetric flow rate is maintained above a second stage surge point. In a related example, a controller is arranged and configured to calculate an enthalpy selected from an enthalpy of the first stage compressor feed and the second stage compressor feed.

Compressor systems described herein may, for example, comprise a compressor; a first compressor stage within the compressor; a second compressor stage within the compressor; an inter-stage flow path connecting the first compressor stage to the second compressor stage; a first compressor stage feed line in fluid communication with the first compressor stage; a supplemental feed line in fluid communication with the inter-stage flow path; a first pressure measurement instrument indicative of the volumetric flow rate through the first compressor stage feed line; a first flow measurement instrument indicative of the volumetric flow rate through the first compressor stage feed line; a second pressure measurement instrument indicative of the volumetric flow rate through the supplemental feed line; a second flow measurement instrument indicative of the volumetric flow rate through the supplemental feed line; and a control valve in fluid communication with the supplemental feed line; wherein the control valve is arranged and configured to respond to signals from: the first pressure measurement instrument, the first flow measurement instrument, the second pressure measurement instrument, and the second flow measurement instrument; wherein the control valve is arranged and configured to respond to a signal indicative of the amount of work imparted to a gas being compressed by the first compressor stage. In a related example, the compressor system may further comprise: a first temperature measurement instrument indicative of a volumetric flow rate through the first compressor stage feed line; and a second temperature measurement instrument indicative of a volumetric flow rate through the supplemental feed line; wherein the control valve is arranged and configured to respond to signals from the first temperature measurement instrument and the second temperature measurement instrument. In a related example, the compressor system may further comprise a molecular weight measuring device wherein the control valve is arranged and configured to respond to changes in a signal from the molecular weight measuring device. In a related example, the compressor system may further comprise a compressible fluid wherein the compressible fluid has a known molecular weight that is substantially constant.

DETAILED DESCRIPTION

Control systems described herein are generally described as configured to maintain the inlet flow rate to each compressor stage at a sufficiently high level to avoid surge. The embodiments that follow discuss the establishment of a "set point," representing a targeted actual volumetric flow rate into individual compressor stages. The set points described in the following examples are expressed in terms of an actual volumetric rate at which surge initially occurs plus a safety factor. During normal compressor operation, at times when no additional flow is needed to prevent surge in a stage, the actual volumetric flow rate into the individual compressor stage may exceed the set point without issue. As the volumetric flow rate decreases, approaching surge conditions for a given stage, the control system will operate a valve configured to supplement the compressor stage inlet flow in order to seek out the flow set point. There are a large number of piping configurations and control configurations which may be employed to control surge based on the techniques described herein. For example, systems generally conforming to the examples described herein could be arranged such that the rate of recycle or supplemental flow to a stage is the variable controlled. In a further related example, control of the recycle or supplemental flow could be conducted to maintain differential pressure of a stream feeding the compressor, in which case the set point may be expressed as a differential pressure. Set points may be established on a component of the flow, such as recycle flow rate, or the total flow. Set points may further be expressed in terms of flow or other parameters that are representative of flow. There are numerous forms these systems may take and numerous ways these methods can be expressed. The following examples represent one form of describing these systems and methods which may be modified to any number of equivalent or substantially equivalent expressions for the practice of those techniques.

Example 1

Single Stage Compressor Control

Figure 1:
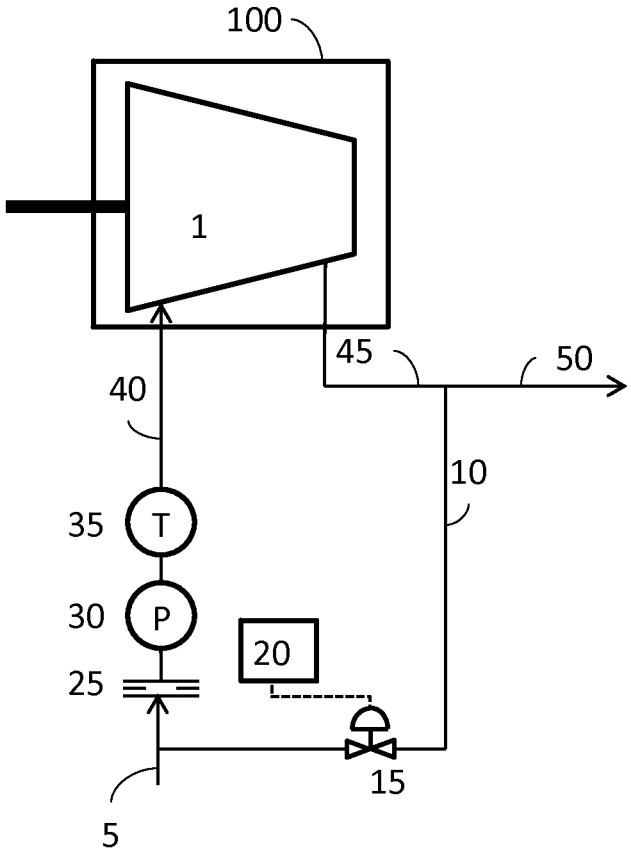
FIG. 1 shows a simplified piping and instrumentation diagram of a single stage compressor, including anti-surge controls.

The present example relates to an embodiment in which surge is controlled in a single stage compressor, compressing a gas with a known or measurable molecular weight. FIG. 1 is a simplified piping and instrumentation diagram of a single stage compressor 100 with first compressor stage 1. A stream requiring compression, identified as first system feed line 5, is joined by a stream of gas identified as recycle via recycle line 10. First system feed line 5 is typically provided by upstream processes. In the case of refrigeration systems, first system feed line 5 contains expanded refrigerants requiring compression to re-initiate the refrigeration cycle. The quantity of recycle is regulated by the recycle control valve 15 based on signals from the recycle controller 20. The recycle controller 20 receives signals from suction flow meter 25, suction pressure sensing device 30, and suction temperature sensing device 35. The recycle controller 20 utilizes algorithms to convert the pressure, temperature and flow signals to a calculated volumetric flow rate through first compressor feed line 40 at actual operating conditions. The recycle controller compares the calculated flow rate through first compressor feed line 40 to a set point which represents the minimum allowable flow rate to safely avoid surge conditions plus a safety factor. This set point may be a fixed value or may likewise be established by algorithms to better account for variable conditions. The recycle controller 20, having compared the calculated actual flow rate through first compressor feed line 40 to the set point, modulates recycle control valve 15 so as to maintain flow at or above the value designated by the set point. The mass flow rate of gas exiting first compressor stage discharge 45 is the same as the mass flow rate at first compressor feed line 40. Compressed gas exits the compressor system through compressor system discharge line 50.

Single stage compressor 100 may be controlled with the aid of the following techniques.

$$Q_s = K_{meter}\sqrt{R\frac{Z_s T_s}{MW}\frac{\Delta P_{os}}{P_s}} \quad \text{(Equation 1)}$$

Where:

$Q_s$ Inlet volumetric flow rate (actual conditions)

$K_{meter}$ Suction flow meter constant

R Ideal Gas Constant $Z_s$ Gas compressibility at compressor suction $T_s$ Gas temperature at compressor suction MW Gas molecular weight $\Delta P_{os}$ Suction flow delta P As mentioned previously, the recycle controller utilizes an algorithm to calculate the flow ($Q_s$) into first compressor feed line 40 and modulates recycle control valve 15 accordingly to assure that the flow through first compressor feed line 40 stays safely above the surge point.

The set point for flow through first compressor feed line 40 is an actual volumetric flow rate that exceeds the volumetric flow rate at which surge begins plus an additional volumetric flow rate in the form of a a predetermined safety factor. The location of the "surge point" on a specific head (H) vs. flow (Q) performance curve is typically near the relative maximum point of the curve (where the head is at its maximum). Information about the surge characteristics of a particular compressor or compressor stage should be obtained from the compressor manufacturer. A single compressor may have multiple head vs. flow performance curves; one for each operable compressor speed. Thus the "surge point" is variable and dependent on actual operating conditions of the compressor. As such, the "surge point" can be expressed as a function, for example based on the compressor speed. Each compressor design has unique performance curves; therefore each compressor design has a unique "surge point" function. A surge point function is constructed by imposing a curve through the surge points for the multiple head vs. flow performance curves. The surge point function of an individual compressor having compressor speed as an independent variable and flow rate as the dependent variable may be used in various embodiments of the invention to more accurately represent the surge point across a range of conditions.

Example 2

Two Stage Compressor Control

The present example describes a scheme for the control of a two stage compressor. A two stage compressor, as presented in FIG. 2, comprises two sets of rotating impellers. The configuration of the first stage, in a two stage system, is very similar to that of the single stage compressor shown in FIG. 1 and described above. However, the source of recycle line 10 feeding first compressor stage 1 in a two stage system may be located downstream of the second stage discharge 95. Embodiments presented in this application discuss all recycle streams originating downstream of the last stage. Although such an arrangement is common, recycle may originate from other locations in the system. In this embodiment, all the first stage discharge 45 flow is routed to the second stage suction 90. Otherwise, control of the first stage of the two stage compressor is accomplished in the same manner of control of the inlet to a single stage compressor as previously described.

Compressed gas from the first stage discharge 45 is supplemented by flow from second compressor feed line 86. Second compressor feed line 86 receives gas from second stage recycle line 60 and second system feed line 72. Second stage recycle line 60 is in fluid communication with the second stage discharge 95. The second stage recycle control valve 65 is modulated according to signals sent from the second stage controller 70 which receives information from pressure sensing device 80, temperature sensing device 85 and flow measurement device 75, suction flow meter 25, suction pressure sensing device 30, and suction temperature sensing device 35 along with information about the energy added to the gas compressed in first stage 1.

The mass flow rate at the first stage discharge 45 is the same as the mass flow rate at first compressor feed line 40. The actual volumetric flow rate is determined through application of the ideal gas law (corrected for inlet gas compressibility) as applied in Equation 1. As discussed previously, the MW of the gas is either known and fixed (for example an air, ammonia, or refrigerant compressor) or measurable with the use of an analyzer. In the present example, the pressure of second stage inlet 90 is obtained from the pressure sensing device 80 located in second compressor feed line 86 (as it is located downstream of the second stage recycle control valve 65). Alternatively, the second stage inlet pressure could be inferred based on compressor performance curve as the increase in pressure ("ΔP") across first compressor stage 1 is a function of the inlet flow rate and the speed of the compressor. The first stage discharge pressure may be determined by adding the estimated ΔP to the measured pressure at the inlet to the first stage.

Typically the temperature of the gas exiting the first stage compressor is unknown. Adiabatic compression of a gas causes the temperature of the gas to increase. More specifically, adiabatic compression of the gas results in an increase in internal energy designated as an increase in specific enthalpy. Applying the first law of thermodynamics, the increase in enthalpy of the gas due to compression is equal to the work performed by the compressor, which is simply a function of the tangential velocity of the gas (as no external heat in added to the gas as part of the process). Thus;

$$\Delta h_{impeller} = q - w = \frac{v_r^2}{2g_c} \quad \text{(Equation 2)}$$

Where:

$\Delta h_{impellers}$ Increase in specific enthalpy per impeller
q Heat input into the system (zero)
w Work done by the gas (negative)
$v_r$ Tangential Velocity of compressed gas
$g_c$ Dimensional gravitational constant In this example, the tangential velocity ($v_r$) is calculated according to the following expression. Other methods of calculating or estimating the velocity of compressed gas, or ultimately the work performed by the compressor may also be used.

$$v_r = \frac{D}{2}N - \frac{Q}{\pi D}\frac{\tan\beta}{W} \quad \text{(Equation 3)}$$

Where:

D Impeller diameter
N Compressor Speed (rad/sec)
Q Inlet volumetric flow rate
β Impeller tip lean angle
W Impeller tip width The work done by a single stage can be estimated using the effective geometry for impellers in the stage, which can be inferred from the compressor head and efficiency performance curves, and can be corrected for compression within the impeller and "slip" at the impeller tip. Calculation of the effective impeller geometry is presented in Example 5.

$$\Delta h_{stage} = \frac{\text{Impellars}}{2g_c}\left[\left[\left(\frac{D}{2}N - \frac{Q}{\pi D}\frac{\tan\beta}{W}\right)\right]^2 + K_{SC}Q^2\right] \quad \text{(Equation 4)}$$

Where:

Impellers Number of impellers in a stage
$K_{SC}$ Slip coefficient

The specific enthalpy of the gas exiting the first stage of the compressor ($h_{d1}$) is the sum of the specific enthalpy of the gas entering the compressor ($h_1$) and the change in specific enthalpy ($\Delta h_1$), or work (w) performed by the compressor. The specific enthalpy of the gas entering the first stage ($h_1$) is readily determined as the physical properties at the inlet of the compressor are measurable or otherwise determinable. In this example, a pressure sensing device 30 and a temperature sensing device 35 are located within the suction line just prior to entry at first compressor feed line 40.

As mentioned at the introduction of the section above, typically the temperature of the gas exiting the first stage compressor is unknown. However, as described above, the specific enthalpy of the first stage discharge can be calculated. The temperature of a gas of known composition and pressure is determinable based on algorithms or charts that relate the specific enthalpy, pressure and temperature for a gas of known composition. Having the molecular weight of the gas, knowledge of three of the four related variables allows determination of the fourth (temperature). Therefore, the temperature and specific enthalpy of the first stage discharge may be calculated through the above described method. Likewise, temperature may be calculated, for gas of a known composition, at any point in the compressor where pressure and specific enthalpy are also known or determinable.

The compressibility factor ("z") of a gas is a function of the pressure, temperature and composition of the gas. Although this factor would be expected to remain fairly constant over operable ranges of a specific compressor stage discharge or inlet, it could be varied based on reliably available curves and correlations based on temperature, pressure and MW of the gas.

The mass flow to the second stage of a compressor, through second stage suction line 90, is made up of flow from first compressor feed line 40, as determined by Equation 1, plus the mass flow through second compressor feed line 86. In this example, the pressure of the second stage inlet is the same as the pressure in second compressor feed line 86 since there is no significant pressure drop between the discharge of the first stage and the inlet of the second stage. Gas passing through second compressor feed line 86 is derived from second stage recycle line 60 and second system feed line 72.

In this example, the temperature of second stage inlet 90 is estimated by determining the specific enthalpy and pressure of the compressed gas of known composition entering the second stage suction and applying algorithms or temperature/pressure/enthalpy curves to estimate the temperature associated with such conditions. The specific enthalpy of the second stage inlet 90 is calculated by weighting the first stage discharge 45 enthalpy ($h_{d1}$) and enthalpy from second compressor feed line 86 ($h_{f2}$) based on their respective mass flow rates. The specific enthalpy of second compressor feed line 86 ($h_{f2}$) is readily determined as the physical properties of the gas in second compressor feed line 86 are measurable or otherwise determinable. In this example, the enthalpy of gas in second compressor feed line 86 ($h_{f2}$) is determined downstream of the recycle control valve 65 where the pressure is approximately the same as the first stage discharge 45 and the temperature is measured. Since the specific enthalpy of the first stage discharge 45 ($h_{d1}$) is capable of reliable estimation and the specific enthalpy of second compressor feed line 86 ($h_{f2}$) is determinable, the specific enthalpy of second stage suction 90 may be determined based on relative mass flow rates as follows;

$$h_{i2} = \frac{F_1 h_{d1} + F_{f2} h_{f2}}{F_2} \quad \text{(Equation 5)}$$

Where:

$h_{i2}$ Specific enthalpy of the gas in second stage suction 90
$h_{d1}$ Specific enthalpy of the gas in first stage discharge 45
$h_{f2}$ Specific enthalpy of the gas in second compressor feed line 86
$F_2$ Mass flow rate through second stage suction 90
$F_1$ Mass flow rate through first compressor feed line 40
$F_{f2}$ Mass flow rate through second compressor feed line 86

The temperature of a gas of known composition, specific enthalpy and pressure can be determined. Thus the temperature of the second stage inlet gas, including effects of compression within the first stage and the second compressor feed 86, may be estimated as per the above procedure.

Figure 2:
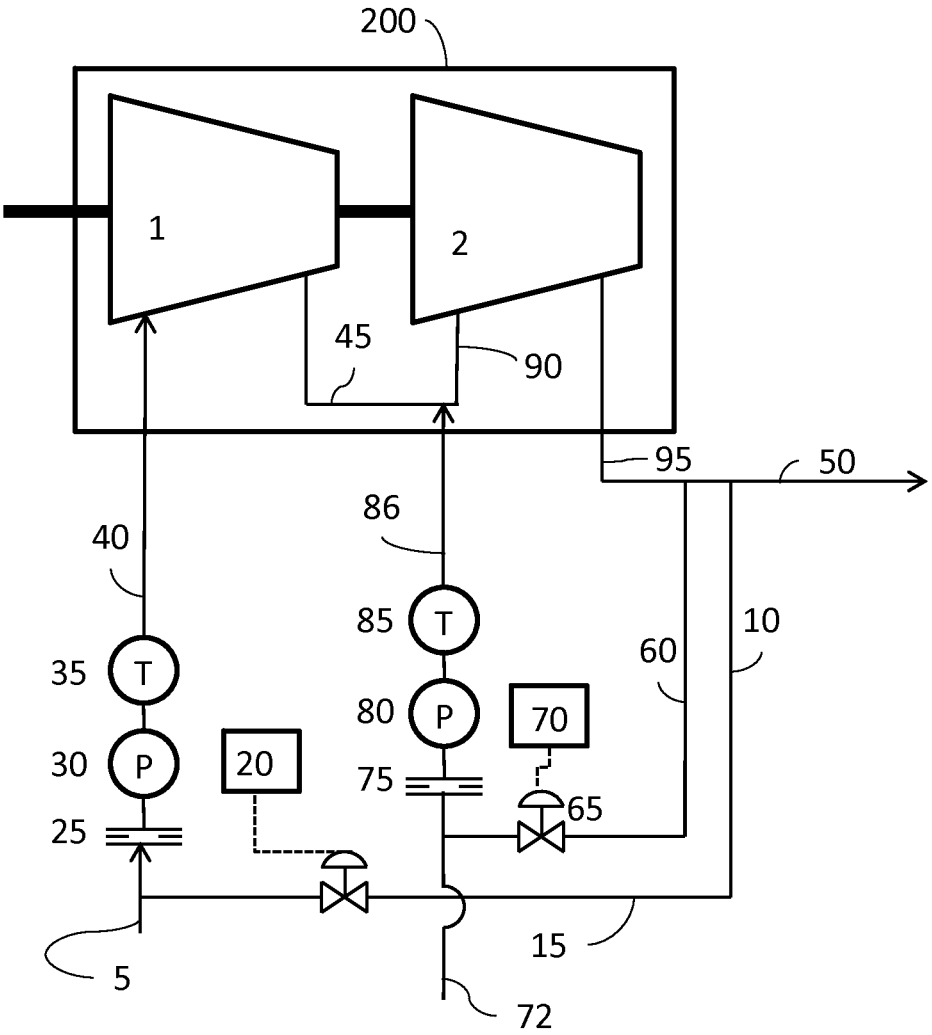
FIG. 2 shows a simplified piping and instrumentation diagram of a two stage compressor, including anti-surge controls.

Utilizing the above information, the present example presents enough information either measurable or known to calculate the inlet actual volumetric flow to the second stage. Referring now to FIG. 2 of the drawings, the sources of this information may include information about the operational speed of the compressor and data from suction pressure sensing device 30, suction temperature sensing device 35, suction flow meter 25, pressure sensing device 80, temperature sensing device 85, and flow measurement device 75. Such information is fed to an instrument controller that utilizes the ideal gas law corrected for inlet gas compressibility to calculate respective flows at actual temperature and pressure conditions resulting in the actual volumetric flow rate of second stage suction 90. In simple terms, the controller will compare the actual volumetric flow rate of second stage suction 90 to a minimum acceptable actual volumetric flow rate which includes a safety factor adequate to protect against surge. Should the actual volumetric flow rate for second stage suction 90 fall below the minimum acceptable rate, recycle control valve 65 will be instructed to open further. Similarly, recycle control valve 65 would close further when the flow rate through second stage suction 90 satisfies the minimum acceptable actual volumetric flow rate. The control setup for the control valve should be such that the valves protecting the compressor against compressor surge are able to open fast enough to respond to all reasonably anticipated process upsets without causing compressor surge.

In one embodiment, the calculated actual volumetric flow rate through second stage suction line 90 is compared to a set point and second stage recycle control valve 65 opens to maintain minimum flow when the calculated actual volumetric flow rate through second stage suction line 90 falls below the set point.

Example 3

Three Stage Compressor Control

Figure 3:
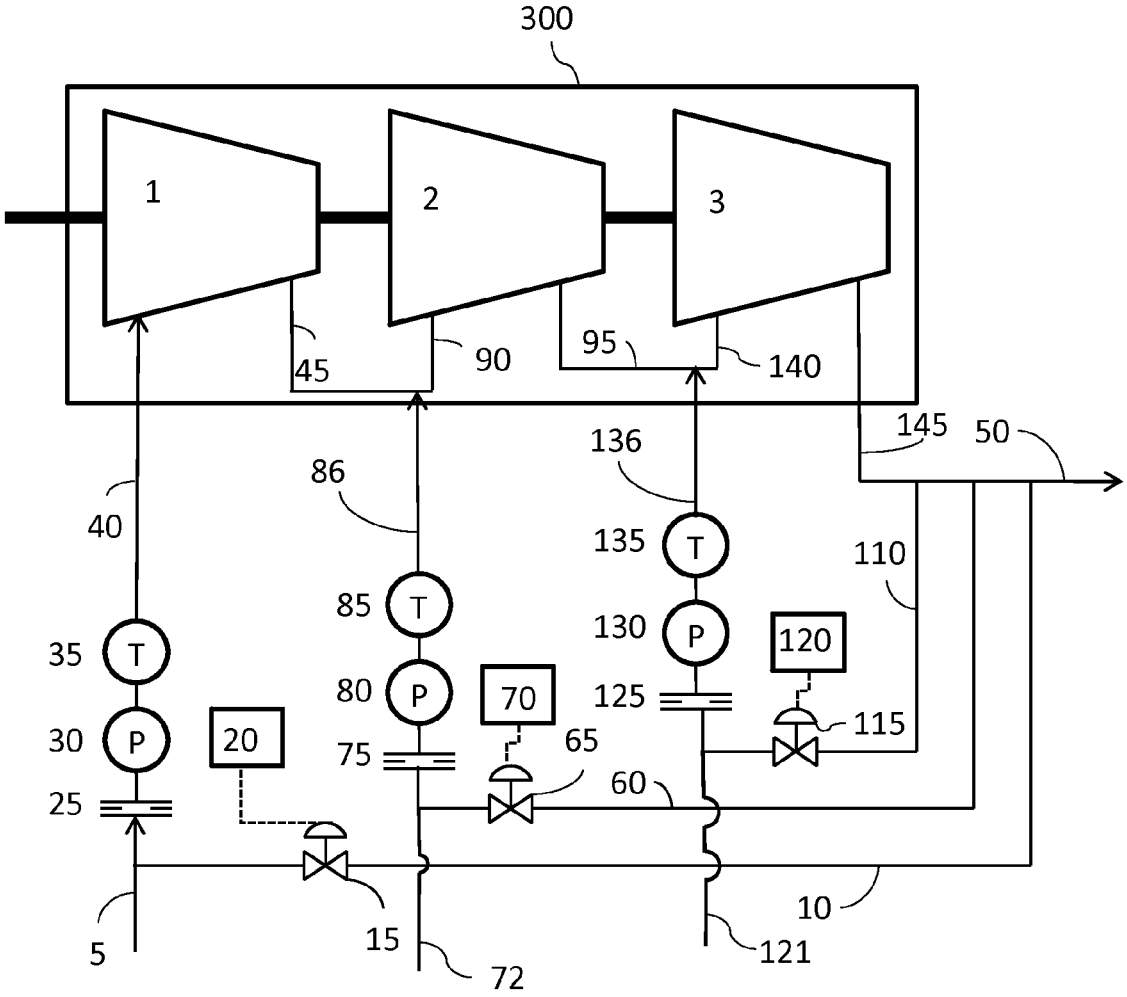
FIG. 3 shows a simplified piping and instrumentation diagram of a multi-stage compressor, including anti-surge controls.

Referring now to FIG. 3 of the drawings, three stage compressor 300, comprises three sets of rotating impellers. The configuration of the first and second stages is very similar to that of a two stage compressor 200 as shown in FIG. 2 and described above except that the source of the first stage recycle line 10 and the second stage recycle line 60 is located downstream of the third stage discharge 145. All the first stage discharge 45 flow is routed to the second stage suction 90 and all of the second stage discharge 95 is routed to the third stage suction 140. Otherwise, control of the first two stages of the three stage compressor is accomplished in the same manner of control as the two stage compressor as previously described.

First system feed line 5 provides gas to be compressed in a three stage compressor as presented in FIG. 3. First system feed line 5 is joined by the first stage recycle through the first stage recycle line 10 as controlled by the first stage recycle control valve 15. The first stage recycle control valve 15 is modulated by signals sent by the first stage recycle controller 20, which receives signals from the suction flow meter 25, the suction pressure sensing device 30, and the suction temperature sensing device 35. As discussed previously, the first stage recycle controller 20 calculates the actual volumetric flow rate through first compressor feed line 40 and compares the actual feed rate to a set point and modulates the first stage recycle control valve 15 so that the flow through first compressor feed line 40 is maintained near or above the set point.

First stage discharge flow 45 is joined by gas from second compressor feed line 86 which is supplied gas by second system feed line 72 and second stage recycle line 60. The second stage recycle control valve 65 is modulated by the recycle controller 70 in the same manner described in Example 2. Second stage discharge line 95 is joined by third compressor feed line 136 to provide gas to third stage suction line 140. Flow through third stage recycle line 110 is controlled by the third stage recycle control valve 115. The third stage recycle control valve 115 is modulated by signals sent by the third stage recycle controller 120, which receives signals from the third stage recycle flow meter 125, the third stage suction pressure sensing device 130, third stage recycle temperature sensing device 135. In addition to information about the flow through third compressor feed line 136 third stage recycle controller 120 accounts for information about the energy imparted by second compressor stage 2 and accounts for the characteristics of the gas supplied through second stage suction line 90 either by retrieving already calculated values for that stream or by calculating values for that stream in a manner comparable to the method described in Example 2. To accomplish this task third stage controller 120 may calculate the enthalpy of the second stage discharge 95, the flow through third compressor feed line 136, and ultimately the volumetric flow through third stage suction line 140. The controller further calculates the third stage suction feed 140 temperature as previously discussed. The determination of the characteristics of the gas in third stage suction line 140 may be calculated utilizing the same techniques described in Example 2 by determining all enthalpy and mass flow contributions from the previous compressor stages and from the flows contributing to flow in third stage suction feed line 140. Flow through third stage suction line 140 comes from second stage discharge line 95 and third compressor feed line 136. Third compressor feed line 136 receives gas from third stage recycle line 110 and third system feed line 121. The third stage recycle controller 120 calculates the actual flow rate through third stage suction line 140 and compares the actual feed rate through third stage suction line 140 to a set point representing the surge point plus a safety factor. Third stage recycle control valve 115 operates based on that set point to maintain volumetric flow through third stage suction line 140 at or above the surge point.

Example 4

Control of Compressors with More than Three Stages

The control of compressors having more than three stages is conducted according to the same principles as the control of compressors having three stages. Calculations are performed for each stage to account for the mass flow rate and enthalpy contributions of each gas source contributing to the compressor stage inlet flow and for the energy imparted to the gas from each preceding compressor stage to arrive at a value for the volumetric flow rate entering each compressor stage. The process of adding stages beyond three is the same as the addition of a stage as from FIG. 1 to FIG. 2 and then from FIG. 2 to FIG. 3. The full discharge from the last compressor stage becomes an inlet stream for the added stage. Each added stage has an independent recycle system where the recycle stream is typically obtained from downstream of the last stage of the compressor. Each recycle system has a controller to assure that the flow into each compressor stage exceeds the minimum required volumetric flow to avoid surge. Each controller may either collect pressure, temperature, and flow data from the relevant streams and may access data from upstream stage(s) required to determine the actual volumetric flow rate to the subsequent stage. Control of the third stage or any subsequent stage is accomplished in the same manner as control of the second stage.

Example 5

Derivations of Effective Impeller Geometry

As discussed in previous examples, embodiments presented require calculation of the gas temperature at the suction of the second and all subsequent stages. Derivation of these gas temperatures is based on calculation of the specific enthalpy of the combined streams (of a known composition) at the suction of each stage. One component of that calculation is the enthalpy of the gas exiting the prior stage. One way to determine the enthalpy at the exit of the stage is to determine the enthalpy of the gas immediately up-stream of the compressor and add the change in enthalpy, or work performed by the compressor.

Compressor vendors produce performance curves specific to a particular compressor design. These curves, Polytropic Head vs. Inlet Volumetric Flow, $H_p$ vs. Q, and Polytropic Efficiency vs. Inlet Volumetric Flow, η vs. Q, can be used to develop a curve representing Effective Head (or increase in enthalpy) vs. Inlet Volumetric Flow based on the following relationship;

$$\Delta h_{stage} = \frac{H_p}{\eta} \quad \text{(Equation 6)}$$

Alternately, the increase in enthalpy across a compressor stage may be calculated based on the geometry of the compressor stage based on the following relationship;

$$\Delta h_{stage} = \frac{\text{Impellars}}{2g_c}\left[\left[\left(\frac{D}{2}N - \frac{Q}{\pi D}\frac{\tan\beta}{W}\right)\right]^2 + K_{SC}Q^2\right] \quad \text{(Equation 7)}$$

It should be noted that for a given compressor the only independent variables in the above equation are compressor speed (N) and inlet volumetric flow ($Q_s$). The change in enthalpy ($\Delta h_{stage}$) is the dependent variable. All other parameters describe the effective geometry, and although their value may be unknown, they are constants. By expanding the above equation and combining constants, it is possible to express the above equation in the following form:

$$\Delta h_{stage} = aN^2 + bQN + cQ^2 \quad \text{(Equation 8)}$$

Thus the change in enthalpy across a compressor stage is:

$$\Delta h_{stage} = \frac{H_p}{\eta} = aN^2 + bQN + cQ^2 \quad \text{(Equation 9)}$$

This equation can be further simplified by dividing each side of the equation by the square of the compressor speed ($N^2$) to derive an easily recognizable quadratic equation.

$$\frac{(\Delta hstage)}{N^2} = \frac{H_{p/\eta}}{N^2} = a + b\left(\frac{Q}{N}\right) + c\left(\frac{Q}{N}\right)^2 \quad \text{(Equation 10)}$$

Utilizing the relationships described in the discussion of Equation 6 and Equation 9, a curve of the change in enthalpy of a stage ($\Delta h_{stage}$) can be constructed by dividing values in the polytropic head vs. inlet volumetric flow curves by values in the polytropic efficiency vs. inlet volumetric flow curves. This new curve produced by that revision, Enthalpy Change vs. Inlet Volumetric flow rate can be further manipulated to produce an additional curve. Because N is constant and known for the newly constructed curve polytropic efficiency vs. inlet volumetric flow the values of points along the curve can be manipulated by dividing the X-axis values by N and the Y-axis values by $N^2$ to produce a new curve enthalpy change/$N^2$ vs. inlet volumetric flow/N. Equation 10 presents enthalpy change/$N^2$ ($\Delta h_{stage}/N^2$) as a quadratic function of inlet volumetric flow/N (Q/N). Curve fitting the quadratic formula of Equation 10 to the curve enthalpy change/$N^2$ vs. inlet volumetric flow/N yields calculated values for the constants a, b and c. Having values for a, b and c, the effective geometric constants of Equation 7 may be calculated by assuming a number of impellers and calculating other terms from the curve fit coefficients.

$$D = \sqrt{4\frac{2g_c}{\text{Impellars}}a} \quad \text{(Equation 11)}$$

$$\frac{\tan\beta}{W} = -\pi\frac{2g_c}{\text{Impellars}}b \quad \text{(Equation 12)}$$

$$K_{SC} = \frac{2g_c}{\text{Impellars}}\left(c - \frac{b^2}{4a}\right) \quad \text{(Equation 13)}$$

Having effective values for D, tan β/W, and $K_{SC}$, Equation 7 can be utilized to predict the enthalpy imparted by a compressor stage as a function of compressor speed and inlet volumetric flow rate. Calculations of the present example should be conducted for each compressor stage for which enthalpy information is needed as described in the preceding examples.

Assumptions made in the calculations, such as the number of impellers, end up producing numbers that are often inconsistent with the actual geometry of the compressor stage but that are useful for the prediction of work done on the gas by the compressor stage. Numbers used in these calculations are often modified by the term "effective" to note that they are not necessarily reflective of actual compressor geometry.

Although recycle streams in the preceding examples are generally laid out as originating from the compressor discharge, alternate embodiments include recycle streams connecting a compressor stage discharge to the suction for that compressor stage, the use of feed from external sources to supplement the main feed to any individual compressor stage, and various other piping configurations designed to provide adequate supplemental flow to a compressor stage for the purpose of preventing surge.

As that phrase is used herein, "contributing to" in the context of flow paths refers to flow streams that make up all or part of the referenced stream. For example, if stream A combined with stream B to form stream C then any one of stream A, stream B or, stream C could be referred to as "contributing to" stream C. As that phrase is used herein, "indicative of" represents information that either alone or in combination with other information may be used to calculate the value of another stated quantity. For example, if stream A and stream B joined to form stream C, then the mass flow rate of stream A would be indicative of the mass flow rate of stream C. As used herein, the phrase "indicative of" has a meaning broad enough to encompass even the mass flow rate of stream C as indicative of the mass flow rate of stream C. The phrase "indicative of" is not broad enough to cover instances where relationship between the information and the reference quantity is insubstantial.

There are, of course, other alternate embodiments which are obvious from the foregoing descriptions of the invention, which are intended to be included within the scope of the invention, as defined by the following claims.

I claim:

1. A method of controlling surge in a multi-stage compressor comprising:

(a) providing a compressor system feed to a compressor having a first stage and a second stage;

(b) discharging a compressor discharge stream from the compressor;

(c) combining a first portion of the compressor discharge stream with the compressor system feed to create a first stage compressor feed having a first volumetric flow rate;

(d) feeding the first stage compressor feed into the first stage;

(e) combining a second portion of the compressor discharge stream with a discharge stream from the first stage at a location within the compressor between the first stage and the second stage to create a second stage compressor feed having a second volumetric flow rate;

(f) feeding the second stage compressor feed into the second stage;

(g) calculating the first volumetric flow rate;

(h) controlling the first portion of the compressor discharge stream such that the first volumetric flow rate is maintained near or above a first set point and such that the first volumetric flow rate is maintained above a first stage surge point;

(i) calculating the second volumetric flow rate; and (j) controlling the second portion of the compressor discharge stream such that the second volumetric flow rate is maintained near or above a second set point and such that the second volumetric flow rate is maintained above a second stage surge point;

(k) wherein the calculating of the second volumetric flow rate includes a calculation of a first stage effective head;

(l) wherein the first stage effective head is calculated as a function of a first stage compressor speed and the first volumetric flow rate; and (m) wherein the function is specific to an impeller geometry of the first stage.

2. The method of claim 1 wherein the function is defined by the equation $$\Delta h_{stage} = \frac{\text{Impellers}}{2g_c}\left[\left[\left(\frac{D}{2}N - \frac{Q}{\pi D}\frac{\tan\beta}{W}\right)\right]^2 + K_{SC}Q^2\right].$$

wherein Impellers is the number of impellers in a stage, $g_c$ is the dimensional gravitational constant, D is the diameter of the impeller, N is the compressor speed in radians per second, Q is inlet volumetric flow rate, β is impeller tip lean angle, W is impeller tip width, and $K_{SC}$ is slip coefficient.

3. The method of claim 1 wherein the function is defined by the equation $$\Delta h_{stage} = aN^2 + bQN + cQ^2$$

wherein N is the compressor speed in radians per second, Q is inlet volumetric flow rate, and a, b, and c are empirically derived constants.

* * * * *